US005960570A

United States Patent [19]

Satzler

[11] Patent Number: 5,960,570

[45] Date of Patent: Oct. 5, 1999

[54] APPARATUS AND METHOD FOR REMOVING SILT FROM UNDER A BODY OF WATER

[75] Inventor: Ronnie L. Satzler, Princeville, Ill.

[73] Assignee: Caterpillar Inc., Peoria, Ill.

[21] Appl. No.: 08/834,676

[22] Filed: Apr. 1, 1997

Related U.S. Application Data

[63] Continuation of application No. 08/834,676, Apr. 1, 1997, abandoned.

[51] Int. Cl.[6] ..... F16L 1/04

[52] U.S. Cl. ..... 37/337; 37/338; 37/190

[58] Field of Search ..... 37/332, 326, 309, 37/190, 328, 338, 189, 91, 94; 56/8, 9; 405/162, 159

[56] References Cited

U.S. PATENT DOCUMENTS

| | | | |
|---|---|---|---|
| 1,196,426 | 8/1916 | Bowling | 37/337 |
| 1,460,558 | 7/1923 | Olden | 37/337 |
| 1,839,929 | 1/1932 | Powell | 37/337 |
| 3,782,317 | 1/1974 | Kriedt et al. | 37/309 X |
| 3,783,626 | 1/1974 | Hansen | 37/307 X |
| 4,214,387 | 7/1980 | Boehme et al. | 37/309 X |
| 4,257,178 | 3/1981 | Spradlin | 37/337 |
| 4,713,896 | 12/1987 | Jennens | 37/309 X |
| 5,311,682 | 5/1994 | Srurdivant | 37/312 X |
| 5,404,696 | 4/1995 | Vasby | 56/9 |
| 5,456,551 | 10/1995 | Saxon | 37/337 X |
| 5,638,620 | 6/1997 | Van Der Kooy | 37/337 X |

*Primary Examiner*—Christopher J. Novosad
*Attorney, Agent, or Firm*—J W Burrows

[57] ABSTRACT

A silt removal apparatus is provided for removing silt from under a body of water. The silt removing apparatus includes a silt removing wheel rotatably mounted on a floatation arrangement. The silt removing wheel has a plurality of silt retaining chambers defined by a plurality of vanes. Once the silt has been retained in the silt retaining chambers a shield mechanism shields the silt from the water as the silt retaining chambers rotates through the body of water. Once the respective silt retaining chambers of the silt removing wheel reaches an upper most position, an ejector mechanism aids in the removal of the silt from the silt retaining chambers. A conveyor arrangement transports the silt to a storage site. In the event an object is wedged between the shield mechanism and the silt removing wheel, a release mechanism trips and the silt removing wheel is stopped in order to remove the object. The subject silt removing apparatus is an effective apparatus to remove silt from under a body of water.

12 Claims, 8 Drawing Sheets

APPARATUS AND METHOD FOR REMOVING SILT FROM UNDER A BODY OF WATER

This is a file wrapper continuation of application Ser. No. 08/834,676, filed Apr. 1, 1997, now abandoned.

TECHNICAL FIELD

The subject invention relates to the removal of silt from a body of water and more particularly to a method and apparatus for removing the silt from a shallow body of water.

BACKGROUND ART

There are various known structures that are designed to remove silt from bodies of water. These known structures are normally designed to remove the silt by scooping the material from the bottom, using a clamshell bucket to dig the material from the bottom, using an auger device to extract the material, or by using a suction type of device to remove the material from the bottom. In these known structures, it is necessary to convey or transport the extracted material to an area or settlement pond in which the silt can separate out from the high volume of water that accompanies the silt. It is quite expensive to provide a location in which the water mixed silt can be deposited in order for the silt to settle out from the water and the water subsequently removed. Furthermore, depending on how far away from the body of water the settlement pond is located, the cost of transporting the water mixed silt may be very high. The time needed to permit the silt to separate from the water, remove the water and allow the silt to dry for subsequent removal from the settlement pond can take weeks. This long time adversely slows the process of removing the silt from the bottom of the body of water. It is desirable to have a quicker and more cost effective manner in which to remove silt from a body of water.

The present invention is directed to overcoming one or more of the problems as set forth above.

DISCLOSURE OF THE INVENTION

In one aspect of the present invention, an apparatus is provided for removing silt from the bottom of a shallow body of water. The apparatus includes a floatation arrangement operative to float on the surface of the body of water, a frame arrangement mounted on the floatation arrangement, and a silt excavating wheel mechanism having an outermost circumference. The wheel mechanism has an axis oriented parallel to the body of water and is rotatably mounted to the frame arrangement. The wheel mechanism is operative to extract silt from under the body of water. The apparatus also includes a conveying arrangement operative to convey the extracted silt away from the excavating wheel mechanism and a height adjusting mechanism operative to raise and lower the excavating wheel mechanism relative to the surface of the water.

In another aspect of the present invention, a method is provided for removing silt from the bottom of a shallow body of water. The method includes the steps of mounting a frame arrangement on a floatation arrangement, mounting a silt excavating wheel mechanism having a plurality of silt retaining chambers on the frame arrangement and rotating the wheel as the floatation arrangement is being moved in a predetermined direction, shielding a portion of the excavating wheel mechanism's outer circumference from the volume of water, shielding a portion of the excavating wheel mechanism's inner circumference from the volume of water, ejecting the silt from the respective silt chambers, and conveying the silt to a transporting mechanism, such as , a barge or conveyer system.

BEST MODE FOR CARRYING OUT THE INVENTION

Figure 1:
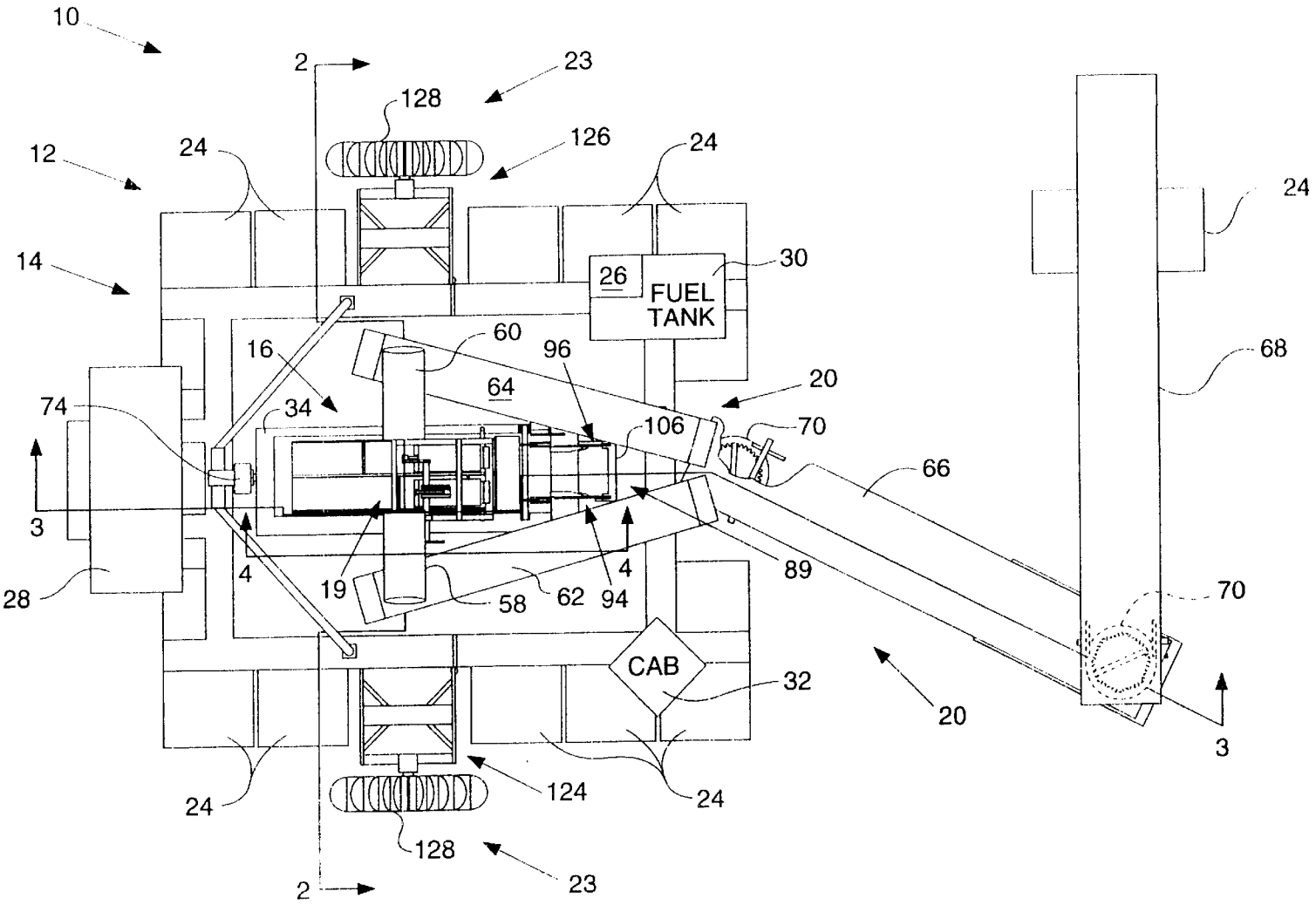
FIG. 1 is a diagrammatic representation of an apparatus incorporating the subject invention.
Figure 2:
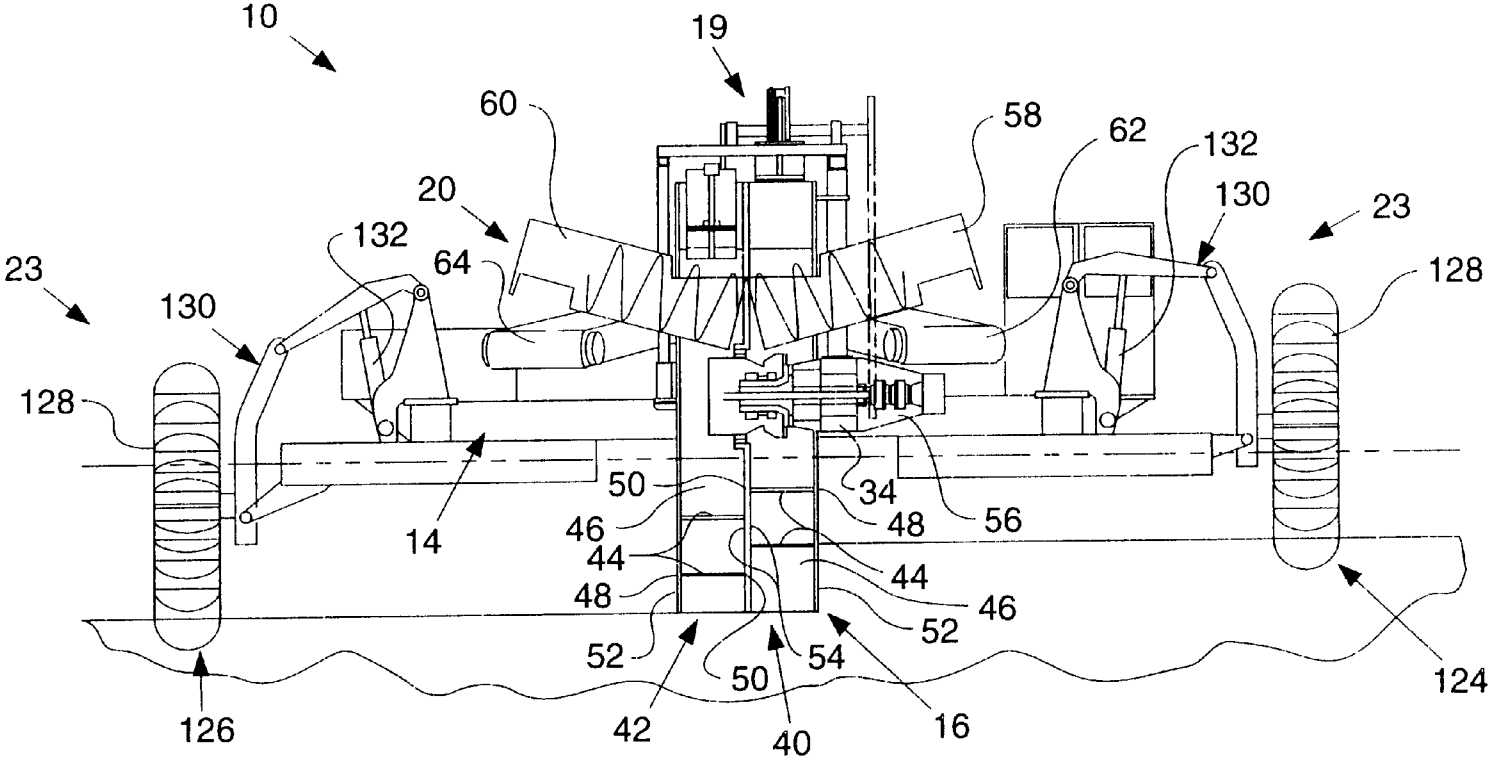
FIG. 2 is a front view of the apparatus of FIG. 1 taken along the line 2—2.
Figure 3:
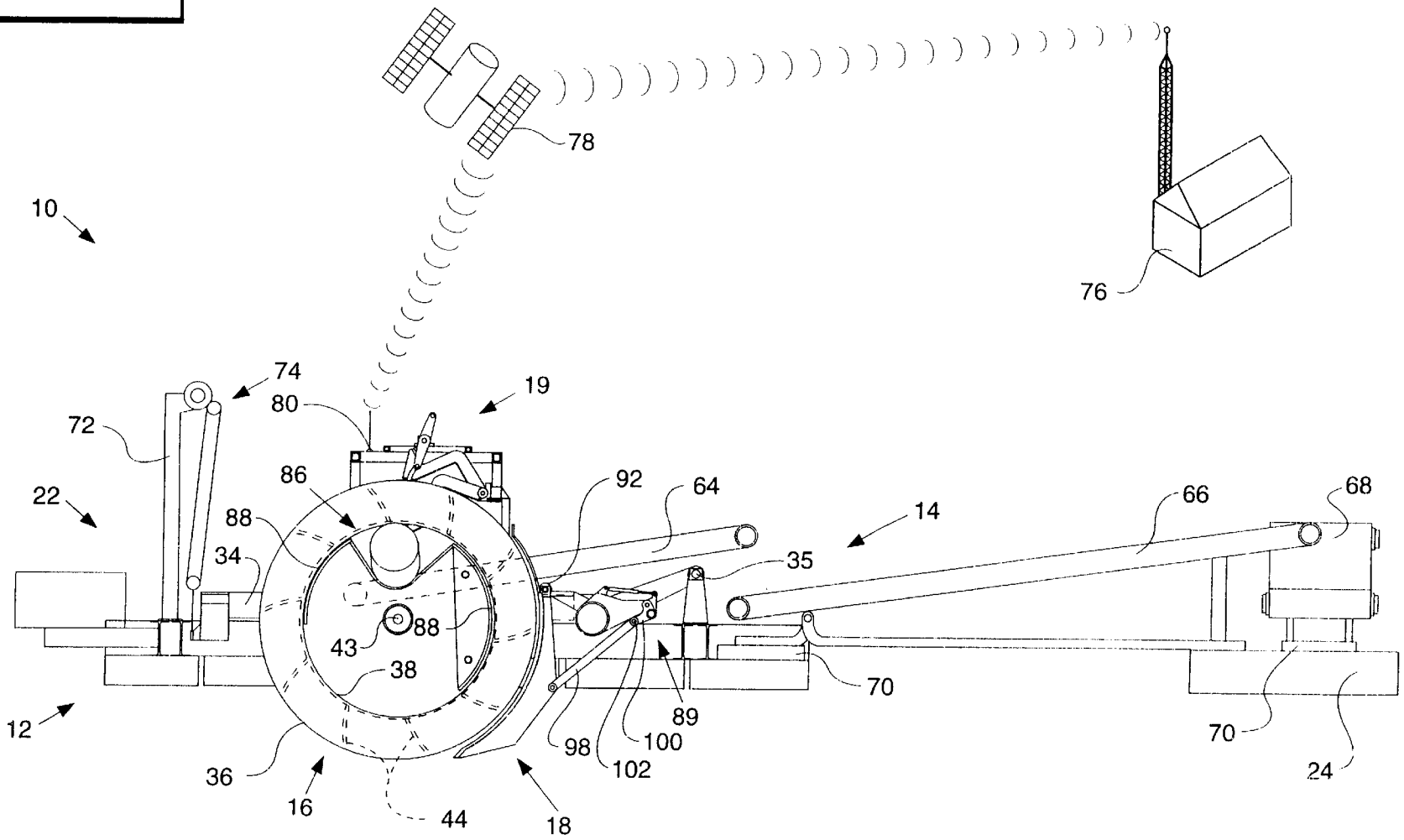
FIG. 3 is a side view of the apparatus of FIG. 1 taken along the line 3—3.

Referring to the drawings and more particularly to FIGS. 1–3, an apparatus 10 is provided and adapted to remove silt from under a body of water. The apparatus includes a floatation arrangement 12, a frame arrangement 14 connected to the floatation 12, a silt excavating wheel mechanism 16 operative to remove the silt from under the body of water, a shield mechanism 18 operative to shield the wheel mechanism 16 from the water during the time the silt is being removed from under the water to a point above the water, an ejector mechanism 19 operative to aid in the removal of the silt from the wheel mechanism 16, a conveying arrangement 20 operative to transport the silt away from the wheel mechanism, and a height adjustment mechanism 22 operative to raise and lower the wheel mechanism 16 relative to the silt under the water. In order to move the apparatus 10 under its own power, a propulsion and steering system 23 is provided.

The floatation arrangement 12 includes a plurality of individual floats 24 interconnected to each other by the frame arrangement 14 to form a platform. The floatation arrangement 12 also includes a buoyancy control arrangement 26. The buoyancy control arrangement 26 is operative to control the level of the platform by increasing or decreasing the buoyancy of at least certain ones of the plurality of floats 24 in order to compensate for changes in weight distribution.

A power source, such as an engine 28, a fluid tank 30 and a cab 32 are mounted on the frame arrangement 14. The location of the engine 28, the fluid tank 30 and the cab 32 could be at different locations on the frame arrangement without departing from the essence of the of the subject invention.

The silt excavating wheel mechanism 16 includes a wheel frame assembly 34 pivotally connected to the frame arrangement 14 at a pivot point 35 and the height adjusting mechanism 22. The silt excavating wheel mechanism 16 has an outermost circumference 36 and an innermost circumference 38 and includes first and second wheel assemblies 40, 42 rotatably mounted to the wheel frame assembly 34 about an axis 43. The first and second wheel assemblies may be secured one to the other or may be made as one integral assembly. The axis 43 is illustrated as being parallel with the surface of the water, but it is recognized that it is not necessary for the axis to be parallel with the water surface. It is recognized that the wheel mechanism 16 could be rotatably mounted to the frame arrangement 14 and have another type of height adjustment control.

Each of the first and second wheel assemblies 40, 42 has a plurality of radially spaced vanes 44 that define respective silt retaining chambers 46. Each of the vanes 44 has opposed ends 48, 50 with first and second opposed sides 52, 54 connected to the opposed ends 48, 50. As illustrated, in the subject embodiment, the sides 54 form a divider between the first and second wheel assemblies 40, 42 and one of the opposed ends of the vanes 44 from each wheel assembly 40/42 is connected to the divider. Each of the respective vanes 44 is located adjacent the outermost circumference 36 between the outermost circumference 36 and the innermost circumference 38. As illustrated, the vanes 44 in one wheel assembly 40 are radially offset from the vanes 44 of the other wheel assembly 42. It is recognized that vanes in the first and second the wheel assemblies 40, 42 do not have to be offset relative to each other. In the subject embodiment, each of the vanes 44 has a curvature or a continuing changing radius that extends from the outermost circumference 36 to the innermost circumference 38. The curvature is provided in order to permit the respective vanes to enter the silt and not create unnecessary turbulence between the silt and the water.

The first and second wheel assemblies are driven by a fluid motor assembly 56 in a conventional manner. In the subject embodiment, a final gear drive arrangement is connected between the fluid motor assembly 56 and the first and second wheel assemblies 40, 42 in order to reduce the size of the fluid motor and to provide the needed torque at a slow speed.

The conveying arrangement 20 includes right and left augers 58, 60, right and left conveyers 62, 64, and first and second transporting conveyers 66, 68. It is recognized that only one transporting conveyer 66 is needed and that more than two conveyers could also be used without departing from the essence of the invention. The right and left augers 58, 60 are operatively located to receive the removed silt from the respective first and second wheel assemblies 40, 42 and deposit it onto the respective right and left conveyers 62, 64. The right and left conveyers 62, 64 moves the silt from the respective augers to the first transporting conveyer 66. As can be readily recognized, additional transporting conveyers 66, 68 could be utilized to remove the silt from the apparatus 10 or the silt could be deposited onto a main conveyer system, barge or other transporting mechanism(not shown) for transporting the silt to a storage area. As illustrated, the transporting conveyers 66, 68 are mounted on floats 24. Respective circle gear assemblies 70 are utilized to orient the first and second transporting conveyers 66, 68 relative to the apparatus 10 and to each other. Consequently, the removed silt can be deposited in a predefined location as the apparatus 10 is being used to continuously remove the silt from under the body of water.

The height adjusting mechanism 22 includes a tower 72 mounted on the frame arrangement 14 and includes a lifting arrangement 74 connected between the top of the tower 72 and the end of the wheel frame assembly 34 opposite to the pivot point 35. The height adjusting mechanism 22 controls the depth that the respective wheel assemblies 40, 42 is permitted to penetrate into the silt below the body of water.

Figure 5:
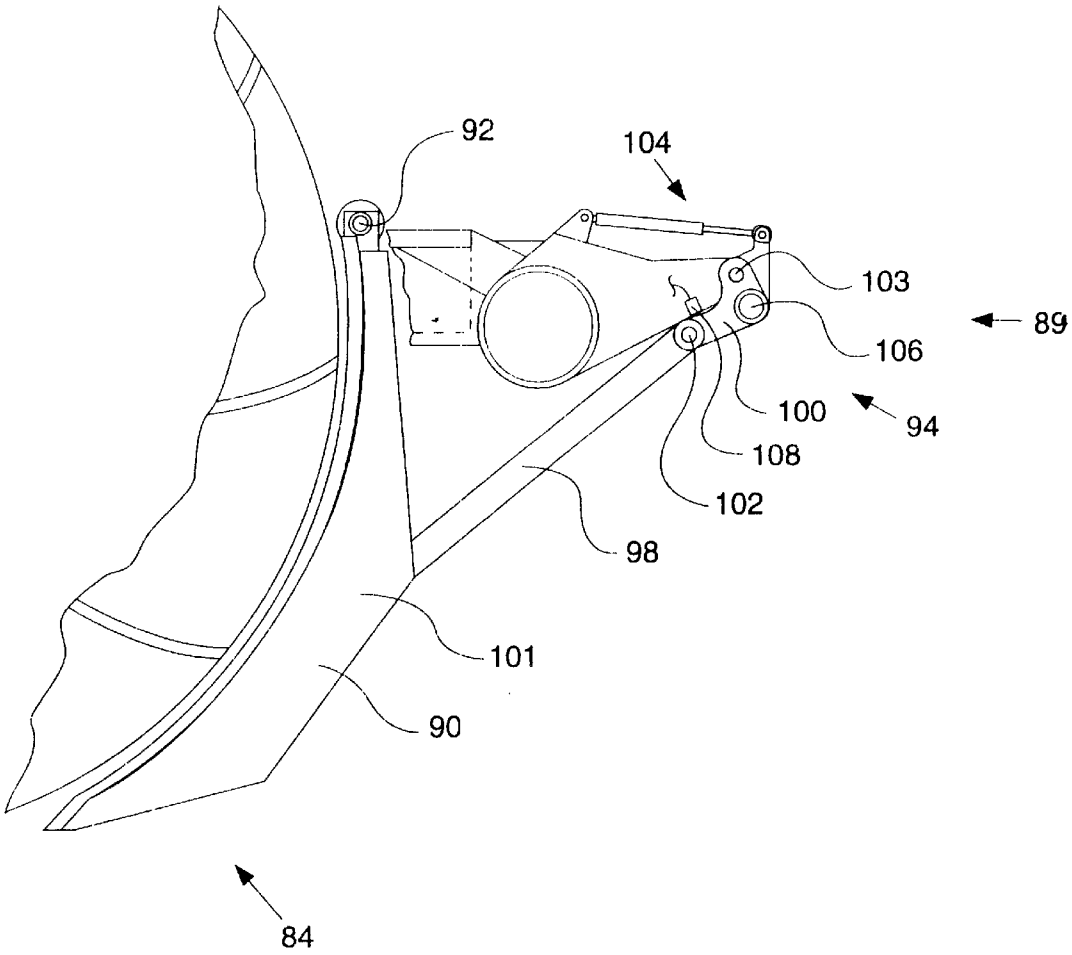
FIG. 5 is an enlarged partial view of a shield mechanism.
Figure 6:
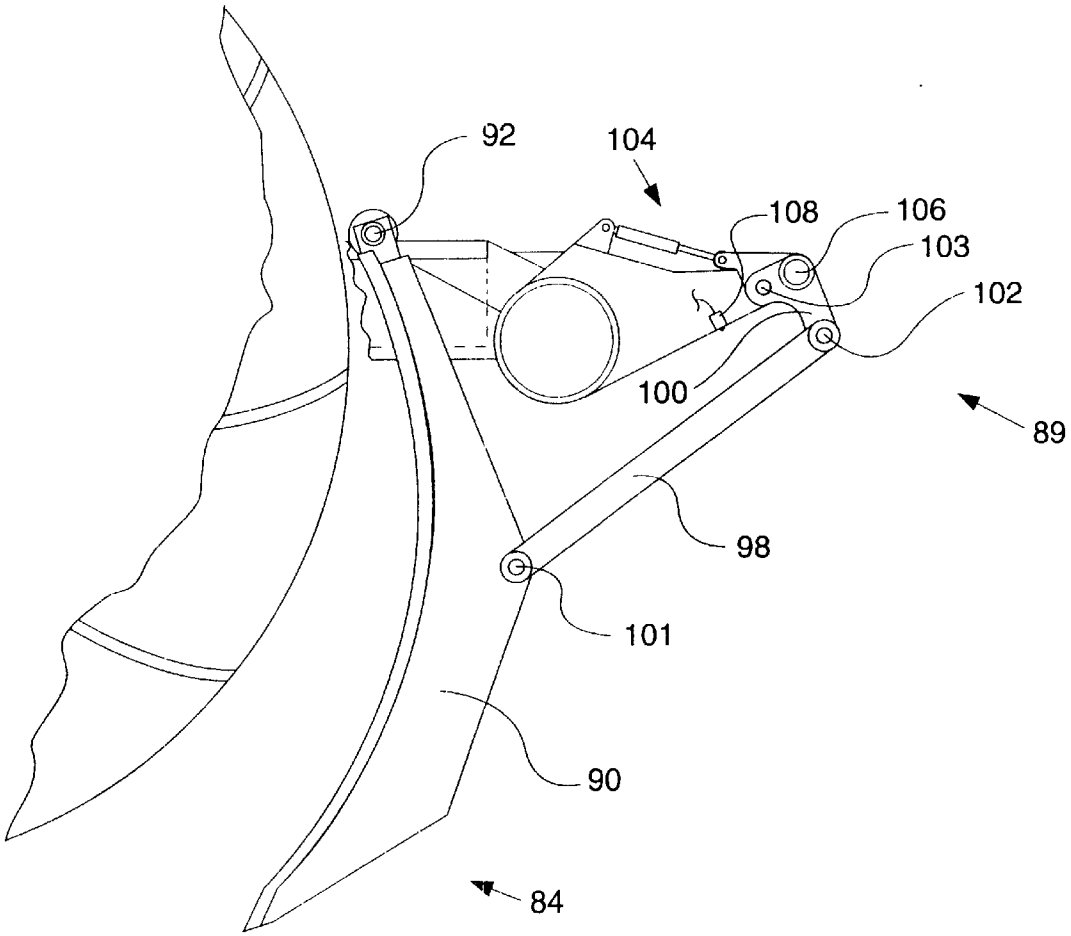
FIG. 6 is an enlarged partial view of the shield mechanism of FIG. 5 in the tripped position.

As illustrated in FIG. 3, the apparatus 10 operates in cooperation with a global positioning system (GPS). The GPS, as is well known, includes a remote office 76 having a transmitter/receiver, a satellite 78, and a receiver/transmitter 80 at the apparatus 10. It is recognized that the GPS could be used only to identify the position of the apparatus relative to the fixed remote office 76 so that the operator can make needed adjustments or it could be used in combination with a controller to automatically control the operation of the apparatus 10. It is also recognized that the apparatus 10 could be controlled without the aid of GPS. For example, the direction of travel could be controlled by use of positioned flags, a laser or other known direction control devices Referring to FIGS. 4–6, the shield mechanism 18 is illustrated in better detail and includes an outer arcuate shield arrangement 84, an inner arcuate shield arrangement 86 and a release mechanism 89. The outer arcuate shield arrangement 84 is located adjacent a portion of the outermost circumference 36 and has a width substantially equal to the width of the vanes 44 in the wheel assembly 40/42. The outer arcuate shield arrangement 84 is located adjacent the portion of the outermost circumference 36 that is on the trailing end of the respective wheel assemblies 40, 42 between the silt under the body of water and a point above the water level. In the subject apparatus, the width of the outer arcuate shield arrangement 84 is substantially equal to the width of both of the first and second wheel assemblies 40, 42 combined.

The outer arcuate shield arrangement 84 includes an arcuate member 90 pivotally connected to the wheel frame assembly 34 at a pivot point 92. The width of the arcuate member 90 is substantially equal to the combined widths of the first and second wheel assemblies 40, 42 and is located adjacent the portion of the outermost circumference of the respective wheel assemblies 40, 42.

The inner arcuate shield arrangement 86 is connected to the wheel frame assembly 34 and disposed along a portion of the respective first and second wheel assemblies 40, 42 adjacent the innermost circumference 38. The inner arcuate shield arrangement 86 includes respective arcuate shield members 88 located adjacent the innermost circumference 38 of each wheel assembly 40, 42 at a location along the silt retaining chambers 46 that are filled with silt to a point just prior to ejection of the silt and along a portion thereof subsequent to the ejection of the silt to a point generally at which the silt retaining chambers 46 reenters the body of water.

The release mechanism 89 is operative to permit the arcuate member 90 of the outer arcuate shield arrangement 84 to pivot away from the wheel assemblies 40, 42 and stop the wheel assemblies 40, 42 in the event an object becomes wedged between the wheel assemblies 40, 42 and the arcuate member 90. The release mechanism 89 of the subject invention includes first and second linkage arrangements 94, 96. Since both of the linkage arrangements 94, 96 are the same, only one of them will be described in detail.

Each of the first and second linkage arrangements 94, 96 include first and second links 98, 100 connected between the arcuate member 90 and the wheel frame assembly 34. One end of the first and second links 98, 100 are pivotally connected to each other at a pivot point 102. The other end of the first link 98 is connected to the arcuate member 90 at a point 101. The other end of the second link 100 is connected to the wheel frame assembly 34 at a point 103. The respective linkage arrangements 94, 96 are biased to their set position by respective fluid cylinder mechanisms 104 that is connected between the second link 100 and the wheel frame assembly 34. When in the set position, the pivot point 102 of the first and second links 98, 100 is located in a position generally adjacent but not along a line extended between the connection points 101 and 103 of the other ends of the first and second links 98, 100 with the arcuate member 90 and the second link 100. In the event an object becomes wedged between the wheel assemblies 40, 42, the force exerted on the arcuate member 90 is transferred therethrough to the linkage arrangements 94, 96. The exerted force causes the first and second links 98, 100 to pivot at the pivot point 102 by overcoming the biasing force created by the fluid cylinder mechanisms 104. In order to ensure that the arcuate member 90 is not placed in a bind, a torque tube 106 is firmly connected between the first and second linkage arrangements 94, 96. In the subject embodiment, the torque tube 106 is disposed between the respective second links 100.

A switch 108 is disposed between the wheel frame assembly 34 and at least one of links 98, 100 and operative to provide a signal to stop the rotation of the wheel assemblies 40, 42 whenever the release mechanism 89 is tripped. Once the object has been removed, the fluid cylinder mechanism 104 resets the linkage arrangements 94, 96 and the wheel assemblies 40, 42 are once again functional.

Figure 4:
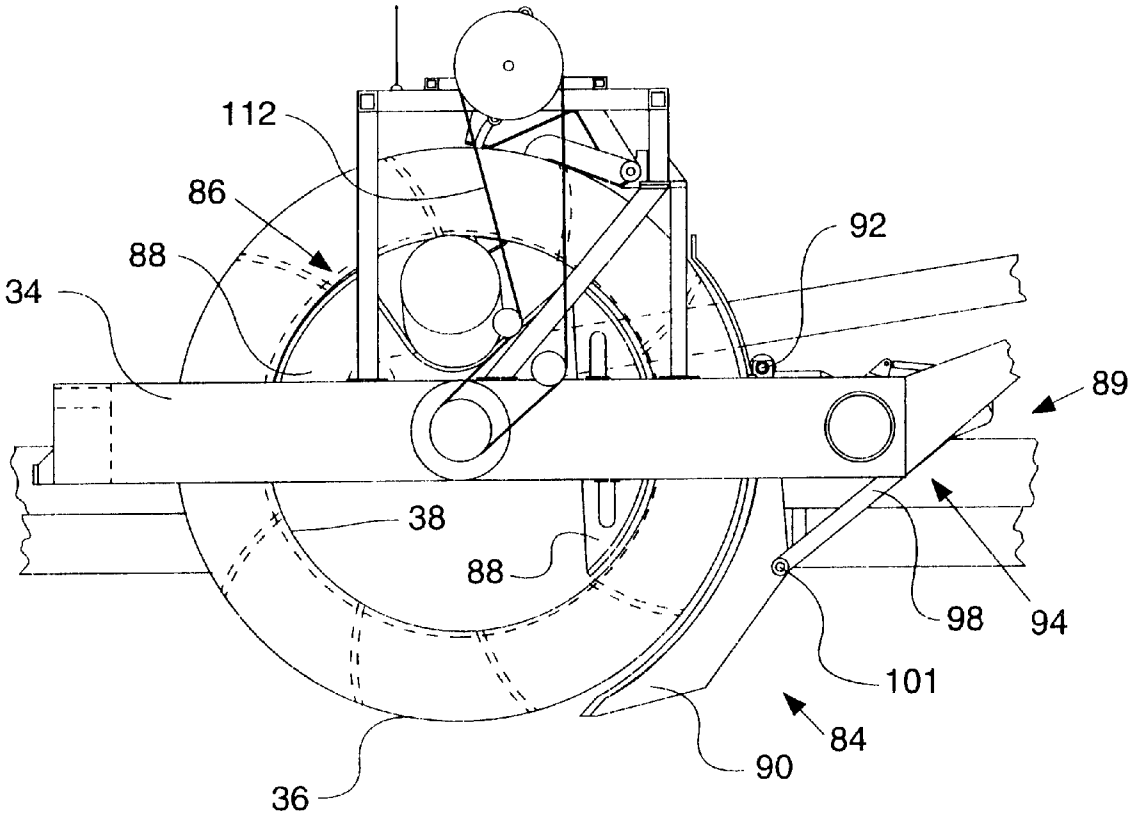
FIG. 4 is an enlarged partial side view taken along the line 4—4 of FIG. 1.
Figure 7:
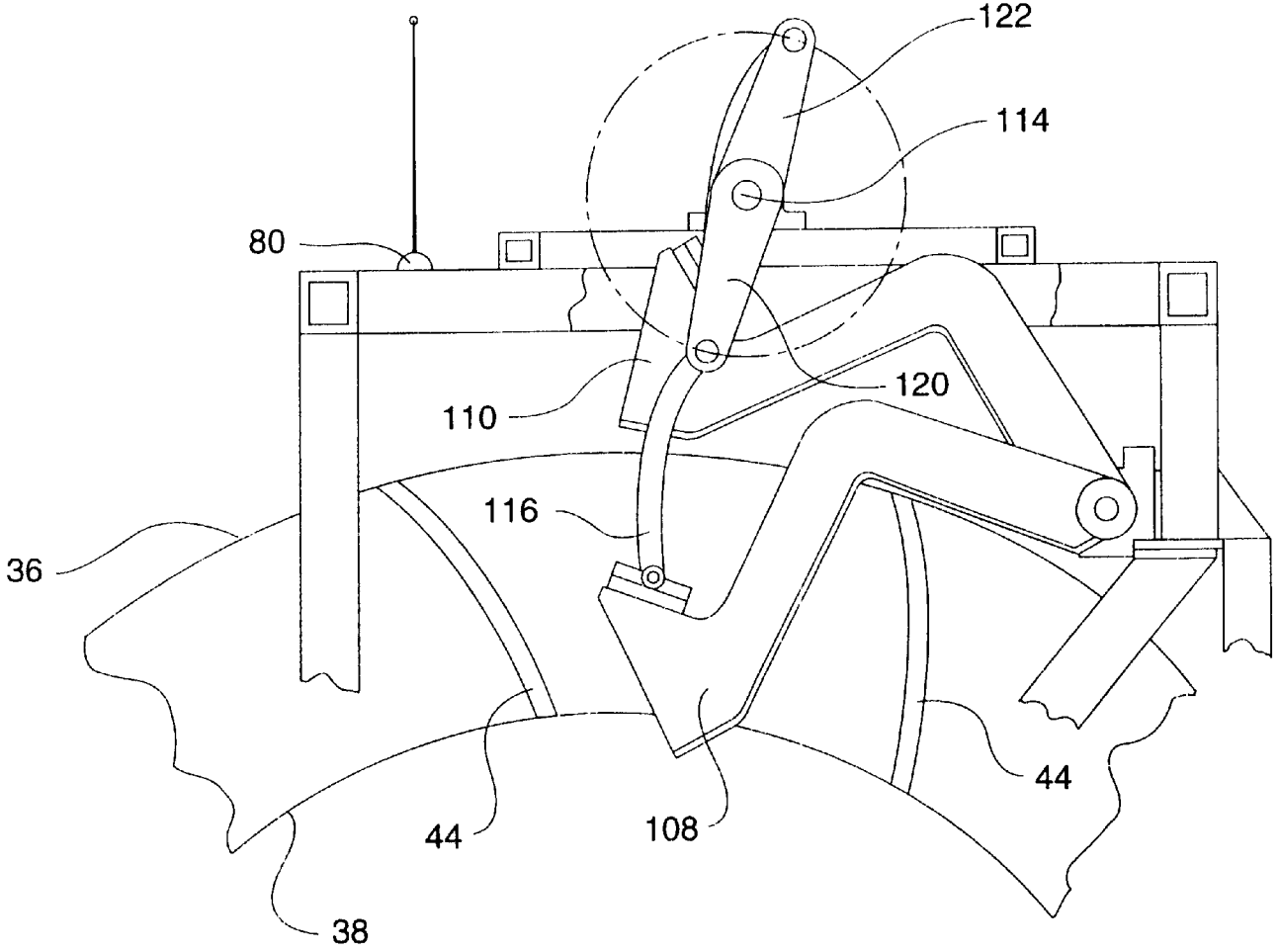
FIG. 7 is an enlarged partial view of an ejector mechanism.
Figure 8:
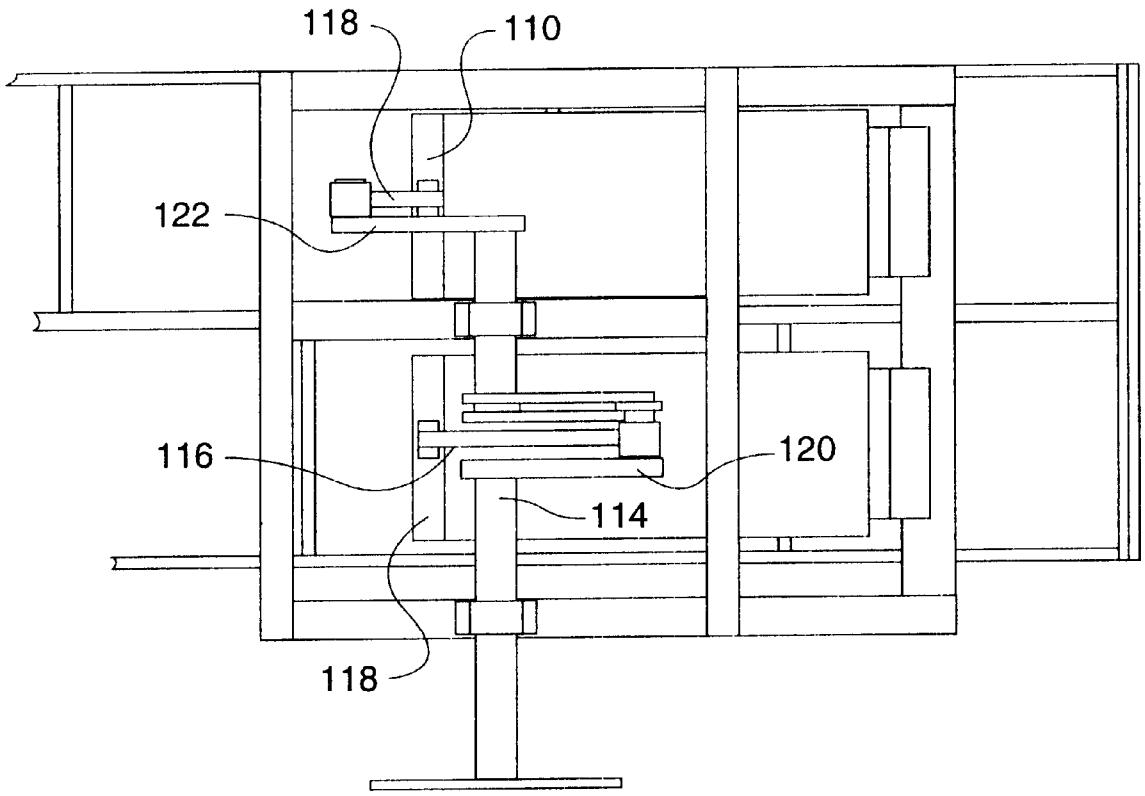
FIG. 8 is a top view of the ejector mechanism of FIG. 7.

Referring to FIGS. 7 and 8 in combination with FIG. 4, the ejector mechanism 19 is illustrated in greater detail. The ejector mechanism 19 is connected to the wheel frame assembly 34 and includes first and second ejector members 109, 110, a timing device 112, such as a chain or belt, a crank member 114, and first and second links 116, 118 connected between the crank member 114 and the respective first and second ejector members 109, 110.

Each of the first and second ejector members 108, 110 has a width that is generally greater than one-half the width of the respective vanes 44 but less than the width thereof. In the subject embodiment, the width of the respective first and second ejector members 109, 110 is approximately 90 percent of the width of the vanes 44.

The crank member 114 has first and second eccentric arms 120, 122 that are oriented 180 degrees from each other. The orientation of the first and second eccentric arms 120, 122 is based on the degree of offset between the vanes of the respective wheel assemblies 40, 42. The timing device 112 turns the crank member 114 in response to the rotation of the wheel assemblies 40, 42. Consequently, each of the ejector members 109, 110 is moved into the associated silt retaining chambers 46 as the wheel assemblies 40, 42 rotates. The ejector mechanism 19 is located generally at the top of the wheel assemblies 40, 42.

As more clearly illustrated in FIGS. 1 and 2, the propulsion and steering system 23 includes first and second independent drive wheel assemblies 124, 126. Since each of the first and second independent drive wheel assemblies 124, 126 are the same only one of them will be described in detail. The respective drive wheel assemblies each include a fluid driven drive wheel 128, a parallelogram linkage 130 disposed between the fluid driven drive wheel 128 and the frame arrangement 14 and a fluid actuated cylinder 132 operative to raise and lower the drive wheel assembly 128. In the subject embodiment, the respective drive wheels 128 have spade shaped members attached to the periphery thereof that are operative to penetrate the silt for traction. The parallelogram linkage 130 is operative in a well known manner to maintain the respective drive wheels in a generally vertical orientation during raising and lowering. Since the respective drive wheels 128 are independently controlled, steering is achieved by turning one drive wheel 128 faster or slower than the other.

INDUSTRIAL APPLICABILITY

Prior to removing silt from a body of water, the depth of water above the silt in the body of water is determined and charted. If the silt removing apparatus 10 is being operated in cooperation with GPS, the charted information is entered into the apparatus' control system and set with respect to the fixed remote location. During use, the drive wheels 128 are lowered into the water until the spades thereof engage the silt, the silt excavating wheel mechanism 16 is lowered into the water to a depth equivalent to the depth necessary for the silt retaining chambers 46 to effectively fill with silt. As the excavating wheel mechanism 16 rotates, the respective silt retaining chambers 46 move through the body of water towards the top most position of the respective wheel assemblies 40, 42. As the silt retaining chambers 46 move through the body of water, the outer arcuate shield arrangement 84 shields the silt in the respective silt retaining chambers 64 from the water. Consequently, the silt does not carry large amounts of water along with the silt. Likewise, the water does not have a tendency to wash the silt from the silt retaining chambers 46. As the wheel assemblies 40, 42 rotate and carry the silt from the bottom towards the top, a portion of the inner arcuate shield arrangement 86 functions to shield the silt from the water and likewise retains the silt in the respective silt retaining chambers 46 prior to the respective silt retaining chambers reaching the top most position of the wheel assemblies 40, 42.

Once the silt retaining chamber reaches the top most position of the wheel assembly 40/42, the silt is in the position to be removed from the silt retaining chamber 46 and deposited in the respective augers 58/60. Prior to the respective silt retaining chamber 46 reaching the top most position, the inner arcuate shield is terminated to allow the silt to exit the silt retaining chamber 46. As the silt retaining chamber 46 reaches the top most position, the appropriate ejector member 109/110 is forced downward to eject the silt from the silt retaining chamber 46. Since the timing device 112 turns the crank member 114 in relation to the turning of the wheel assemblies 40, 42, the associated link member 116/118 moves the appropriate ejector member 108/110 downward into the silt retaining chamber 46. As the wheel continues to rotate, the other portion of the inner arcuate shield 86 functions to shield or close the respective silt retaining chambers 46. In the event all of the silt did not fall from the silt retaining chamber 46 and would attempt to fall into the water, the inner arcuate shield 86 prohibits the silt from falling. Any silt falling back into the water tends to agitate the water and causes undo mixing of the water and the silt at the bottom of the body of water.

In the subject embodiment, the excavating wheel mechanism 16 is turning in the same direction as the respective drive wheels 128. Consequently, the drive wheels 128 may be serving as a braking wheel or may merely be turning with little or no power being introduced thereto. The apparatus 10 is moving forward at a rate generally equivalent to that necessary for the respective silt retaining chambers 46 to completely fill with silt. If the silt retaining chamber 46 is not totally filled, there is a possibility that the remaining unfilled portion may fill with unwanted water. It is believed that in the subject embodiment, the excavating wheel mechanism will turn at the rate of about one revolution per minute. The turning rate of the wheel assemblies 40, 42 is based on the size of the wheel assemblies. In the subject arrangement, the wheel diameter is about six meters in diameter and about two meters in total width. It is recognized that various wheel diameters and wheel widths could be used without departing from the essence of the invention.

Once the silt has been ejected from the silt retaining chambers 46 into the respective augers 58, 60, the augers moves the silt outwardly and deposits it onto the respective first and second conveyers 62, 64. The conveyers 62, 64 moves the silt and dumps it onto the conveyor 66 which in turn moves the silt and dumps it onto the conveyer 68. The conveyer 68 in turn dumps the silt onto a continuous conveyor or some other collection device which moves the silt to a storage stockpile site. One possible storage site would be to deposit the silt into large stockpiles in the body of water or to deposit the silt into long stockpiles in the body of water. This would alleviate the need and costs to haul the material away in trucks.

In the event that an object becomes wedged between the wheel assemblies 40, 42 and the arcuate member 90 during the silt removal process, the release mechanism 89 trips and the wheel assemblies 40, 42 stop. The wheel assemblies may be stopped by the operator after receiving a signal from the switch 108 or it may be automatically stopped once the release mechanism 89 is tripped. Once the object has been removed, the cylinder arrangement 104 resets the release mechanism 89 and the apparatus is ready to continue removing silt from under the body of water.

As previously noted, the apparatus is steered by altering the speed of the first and second drive wheels 128 relative to each other. Since the GPS has the depth of water already charted and likewise knows the general terrain of the body of water, the silt removing process can be continuously ran with very little operator control.

The subject apparatus 10 is primarily intended to remove silt from under a body of water in which the depth of water is normally not greater than 1 to 1.5 meters deep. Once the silt has been removed from the body of water, it is desirable that the depth of the body of water be in the range of 2 to 2.5 meters deep.

As the apparatus 10 is being used for long periods of time, the volume of fuel in the fuel tank 30 is consumed thus effecting the weight distribution. As the fuel is being consumed the buoyancy control arrangement senses the change in the weight distribution and automatically changes the buoyancy in certain ones of the floats 24 to correct the weight distribution.

The circle gear assemblies 70 operate to maintain the position of the conveyor 68 relative to the main conveyor system as the apparatus moves forward during silt removal. This relationship is automatically controlled by the GPS or it may be manually controlled by an operator.

In view of the forgoing, it is readily apparent that the silt removal apparatus 10 is an efficient system to remove silt from under a body of water and stockpile the removed silt. The subject apparatus is effective in removing the silt while prohibiting large amounts of water from being removed with the silt. Likewise, by using GPS, the entire silt removal process can be carried out without requiring a large amount of manual input and can be continuously ran without having to wait until the water has been separated from the silt.

Other aspects, objects and advantages of the invention can be obtained from a study of the drawings, the disclosure and the appended claims.

I claim:

1. An apparatus adapted for removing silt from the bottom of a body of water, the apparatus comprising:

a floatation arrangement operative to float on the surface of the body of water;

a frame arrangement mounted on the floatation arrangement;

a silt excavating wheel mechanism having an outermost circumference, an innermost circumference spaced inwardly from the outermost circumference, an axis oriented parallel to the surface of the body of water, a plurality of radially spaced vanes having opposed ends and being located inwardly of and adjacent the outermost circumference and first and second opposed sides connected to the respective opposed ends of the vanes to form a plurality of silt receiving chambers, the silt excavating wheel mechanism being rotatably mounted to the frame arrangement, and operative to extract silt from under the body of water;

a shield arrangement having an outer arcuate shield arrangement and an inner arcuate shield arrangement, the outer arcuate shield arrangement having a width substantially equal to the width of the respective vanes and being connected to the frame arrangement at a location adjacent a portion of the outermost circumference of the excavating wheel mechanism, the inner arcuate shield arrangement having a width substantially equal to the width of the respective vanes and being connected to the frame arrangement at a location adjacent a portion of the innermost circumference;

a conveying arrangement operative to convey the extracted silt away from the excavating wheel mechanism; and a height adjusting mechanism operative to raise and lower the excavating wheel mechanism relative to the surface of the body of water.

2. The apparatus of claim 1 wherein the excavating wheel mechanism includes first and second adjacent excavating wheel assemblies each having a plurality of radially spaced vanes having opposed ends and being located adjacent the outermost circumference, a divider is disposed between the first and second adjacent excavating wheel assemblies and connected to one end of each vane, and the first and second opposed sides are connected to the other end of the respective vanes to form the plurality of silt receiving chambers.

3. The apparatus of claim 2 wherein the plurality of vanes in the first excavating wheel assembly is radially offset from the plurality of vanes in the second excavating wheel assembly.

4. The apparatus of claim 3 wherein the first and second excavating wheel assemblies has a width and the width of the outer arcuate shield arrangement is substantially equal to the width of the first and second excavating wheel assemblies and the second excavating wheel assembly has an inner circumference and an inner shield connected to the frame and located adjacent the inner circumference of the second excavating wheel assembly.

5. The apparatus of claim 4 wherein the floatation arrangement includes a plurality of individual floats to provide buoyancy and that are interconnected by the frame arrangement and a buoyancy control arrangement operative to adjust the buoyancy of at least a portion of the plurality of individual floats.

6. The apparatus of claim 1 wherein the silt excavating wheel mechanism includes a wheel frame assembly having an excavating wheel assembly rotatably mounted thereon and includes an ejector mechanism connected to the wheel frame assembly.

7. The apparatus of claim 6 wherein the excavating wheel assembly has a top that is furthest away from the surface of the body of water and the ejector mechanism includes an ejector member located generally adjacent the top of the excavating wheel assembly and operative to push the silt from the respective silt receiving chambers.

8. The apparatus of claim 7 wherein movement of the ejector member is in response to rotation of the excavating wheel assembly.

9. The apparatus of claim 1 including a control arrangement operative to aid in controlling the the apparatus.

10. The apparatus of claim 9 wherein the control arrangement is a global positioning system.

11. A method of removing silt from under a body of water, the method comprising:

mounting a frame arrangement on a floatation arrangement;

mounting a silt excavating wheel mechanism having a circumference and having a plurality of silt retaining chambers on the frame arrangement, the silt retaining chambers being defined around the circumference of the excavating wheel mechanism with an innermost and an outermost circumference of each silt retaining chamber being open;

rotating the silt excavating wheel mechanism as the floatation arrangement is being moved in a predetermined direction;

shielding the outermost circumference of a portion of the silt retaining chambers from the water of the body of water;

shielding the innermost circumference of a portion of the silt retaining chambers from the water of the body of water;

ejecting the silt from the respective silt retaining chambers; and conveying the silt to a transporting mechanism for subsequent stockpiling.

12. The method of claim 11 wherein in the step of rotating the excavating wheel mechanism includes the step of rotating the silt excavating wheel mechanism at a rate proportional to the moving of the floatation arrangement.

* * * * *